US008708195B1

(12) United States Patent
Duran

(10) Patent No.: US 8,708,195 B1
(45) Date of Patent: Apr. 29, 2014

(54) BIFURCATED ALCOHOLIC BEVERAGE DISPENSER AND ASSOCIATED USE THEREOF

(76) Inventor: Lindsay Duran, Mission Viejo, CA (US)

( * ) Notice: Subject to any disclaimer, the term of this patent is extended or adjusted under 35 U.S.C. 154(b) by 15 days.

(21) Appl. No.: 13/439,807

(22) Filed: Apr. 4, 2012

Related U.S. Application Data

(60) Provisional application No. 61/471,256, filed on Apr. 4, 2011.

(51) Int. Cl.
*B67D 7/06* (2010.01)

(52) U.S. Cl.
USPC ..... 222/94; 222/153.05

(58) Field of Classification Search
USPC ..... 222/94, 481, 482, 389, 386, 153.05, 222/153.06, 153.07
See application file for complete search history.

(56) References Cited

U.S. PATENT DOCUMENTS

| | | | | | |
|---|---|---|---|---|---|
| 1,522,246 | A * | 1/1925 | Jefferson | 222/94 |
| 2,881,953 | A * | 4/1959 | Kuschel | 222/94 |
| 2,932,385 | A * | 4/1960 | Vokaty et al. | 206/219 |
| 3,189,227 | A * | 6/1965 | Hobbs et al. | 222/94 |
| 3,261,381 | A * | 7/1966 | Roach | 141/114 |
| 3,913,734 | A * | 10/1975 | Siegel | 206/470 |
| 3,983,994 | A * | 10/1976 | Wyslotsky | 206/219 |
| 4,029,231 | A * | 6/1977 | Jonsson | 215/256 |
| 4,358,028 | A | 11/1982 | Chiquiar-Arias | |
| 4,632,244 | A * | 12/1986 | Landau | 206/219 |
| 5,207,320 | A * | 5/1993 | Allen | 206/220 |
| 6,557,731 | B1 * | 5/2003 | Lyon et al. | 222/94 |
| 7,241,066 | B1 * | 7/2007 | Rosen et al. | 401/183 |
| 8,100,294 | B2 * | 1/2012 | May et al. | 222/129 |
| 8,376,183 | B1 * | 2/2013 | Rosen | 222/1 |
| 2005/0072442 | A1 * | 4/2005 | Licari et al. | 132/112 |
| 2005/0155974 | A1 | 7/2005 | Amron | |
| 2005/0279776 | A1 * | 12/2005 | Decottignies et al. | 222/386 |
| 2006/0065758 | A1 | 3/2006 | Hamer | |
| 2007/0119862 | A1 * | 5/2007 | Backes et al. | 222/94 |
| 2007/0187429 | A1 * | 8/2007 | Farahmand | 222/94 |
| 2007/0278251 | A1 * | 12/2007 | Guerrera et al. | 222/327 |
| 2008/0083348 | A1 * | 4/2008 | Kuo et al. | 106/35 |

* cited by examiner

*Primary Examiner* — Paul R Durand
*Assistant Examiner* — Donnell Long

(57) ABSTRACT

A bifurcated alcoholic beverage dispenser for isolating a plurality of alcoholic mixtures in separate compartments before consumption preferably includes a bifurcated body having first and second ends each being independently opened from a closed position. A divider is disposed within the body. First and second compartments are located at proximal and distal portions of the body and isolated by the divider. A first fluid is housed within the first compartment, and a second fluid is housed within the second compartment. Advantageously, the first and second fluids are independently dispensed from the first and second compartments when the first and second ends are independently opened, respectively.

10 Claims, 5 Drawing Sheets

BIFURCATED ALCOHOLIC BEVERAGE DISPENSER AND ASSOCIATED USE THEREOF

CROSS REFERENCE TO RELATED APPLICATIONS

This application claims the benefit of U.S. Provisional Application No. 61/471,256, filed Apr. 4, 2011, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

This non-limiting exemplary embodiment(s) relates to alcoholic beverage dispensers and, more particularly, to a bifurcated alcoholic beverage dispenser for isolating a plurality of alcoholic mixtures in separate compartments before consumption.

2. Prior Art

Consider the millions of adult consumers who enjoy an aperitif, a cocktail, a shooter, or an after-dinner drink. Now consider the number of times and places where these people might enjoy a drink, but cannot conveniently have one: at their kid's football game on a cold November day, for example, or when walking in a city park. We're not talking about getting drunk here—merely about enjoying the taste and stimulation of a fine cognac 4 or liqueur, a mixed drink or shooter in a different, more portable form, outside the confines of home or a cocktail lounge.

Accordingly, a need remains for disposable alcoholic beverage dispenser in order to overcome the above-noted shortcomings. The non-limiting exemplary embodiment(s) satisfies such a need by providing a bifurcated alcoholic beverage dispenser that is convenient and easy to use, lightweight yet durable in design, versatile in its applications, and designed for single use.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a bifurcated alcoholic beverage dispenser for isolating a plurality of alcoholic mixtures in separate compartments before consumption. These and other objects, features, and advantages of the non-limiting exemplary embodiment(s) are provided by a bifurcated alcoholic beverage dispenser including a bifurcated body having first and second ends each being independently opened from a closed position. A divider is disposed within the body. First and second compartments are located at proximal and distal portions of the body and isolated by the divider. A first fluid is housed within the first compartment, and a second fluid is housed within the second compartment. Advantageously, the first and second fluids are independently dispensed from the first and second compartments when the first and second ends are independently opened, respectively.

In a non-limiting exemplary embodiment, the body is formed from a flexible plastic sheath such that the first and second ends are torn open from the closed position. Alternately, the first and second ends may be opened via a removable seal, end cap or other suitable way for providing access to an interior of the bifurcated body without prematurely discharging the first and second fluids isolated therein.

In a non-limiting exemplary embodiment, one of the first and second fluids remains situated within a corresponding one of the first and second compartments, respectively, after another one of the first and second fluids is discharged from another corresponding one of the first and second compartments, respectively.

In a non-limiting exemplary embodiment, the first and second fluids are prohibited from traveling beyond the divider and thereby respectively prohibited from entering the second and first compartments.

In a non-limiting exemplary embodiment, the divider spans across an entire internal cross-section of the body such that the first fluid is prohibited from contacting the second fluid.

In a non-limiting exemplary embodiment, the divider includes first and second plates abutted against each other and facing the first and second compartments, respectively.

In a non-limiting exemplary embodiment, the first compartment begins from the first plate and terminates at the first end of the body.

In a non-limiting exemplary embodiment, the second compartment begins at the second plate and terminates at the second end of the body.

In a non-limiting exemplary embodiment, a tear-away seal is wrapped about the divider and thereby holds the first and second plates at an abutted relationship. In this manner, the first plate is detached from the second plate when the tear-away seal is unwrapped from the divider such that the first and second compartments become separated and spaced apart.

In a non-limiting exemplary embodiment, the present disclosure further includes a method of utilizing a bifurcated alcoholic beverage dispenser for isolating a plurality of alcoholic mixtures in separate compartments before consumption. Such a method preferably includes the chronological steps of: providing a bifurcated body having first and second ends situated at open positions, respectively; providing and disposing a divider within said body; providing and locating first and second compartments at proximal and distal portions of said body such that said first and second compartments are isolated by said divider.

The method further includes the chronological steps of: providing and housing a first fluid within said first compartment; independently closing said first end of said bifurcated body; providing and housing a second fluid within said second compartment; independently closing said second end of said bifurcated body; and independently dispensing said first and second fluids from said first and second compartments by independently opening said first and second ends of said bifurcated body, respectively.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
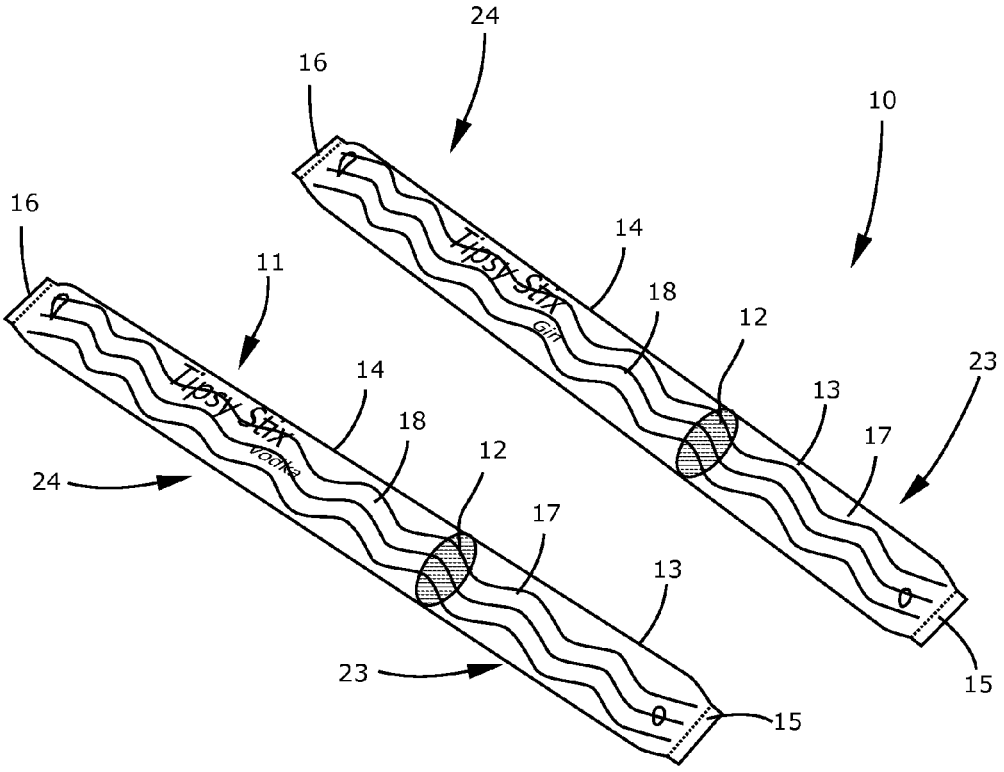
FIG. 1 is a perspective view showing a pair of bifurcated fluid dispensing bodies, in accordance with the non-limiting exemplary embodiment(s)

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment (s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment (s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment (s). The appearances of the phrase "non-limiting exemplary emboidment" in various places in the specification are not necessarily all meant to refer to the same embodiment(s).

Directional and/or relationally terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

The apparatus of this invention is referred to generally in FIGS. 1-5 and is intended to provide a bifurcated alcoholic beverage dispenser 10 for isolating a plurality of fluids (e.g., alcohol, juices, milk, etc.) in separate compartments 13, 14 within the dispenser 10 before consumption and further for allowing a user to quickly and sequentially access each fluid 17, 18 in each separate compartment 13, 14. It should be understood that the present invention may be used to house liquid and gel-like substances containing many types of alcohol, and should not be limited to any particular fluid described herein.

Referring to FIGS. 1-5 in general, a bifurcated alcoholic beverage dispenser 10 for isolating a plurality of fluids 17, 18 (e.g., alcoholic mixtures, etc.) in separate compartments 13, 14 before consumption includes a bifurcated body 11 having first and second ends 15, 16 each being independently opened from a closed position (e.g., tearing a sealed end, removing an end cap, biting off a tip, etc.). A divider 12 is disposed within the body 11. First and second compartments 13, 14 are located at proximal and distal portions 23, 24 of body 11 and isolated by divider 12. A first fluid 17 is housed within first compartment 13, and a second fluid 18 is housed within second compartment 14. Advantageously, the first and second fluids 17, 18 are independently dispensed from the first and second compartments 13, 14 when the first and second ends 15, 16 are independently opened, respectively. Such a structural configuration provides the unexpected and unpredictable advantage of allowing a user to take a shot of liquor and quickly follow it with a beer chaser.

In a non-limiting exemplary embodiment, body 11 is formed from a flexible plastic sheath wherein the first and second ends 15, 16 are torn open from the closed position (i.e., sealed during transport). Alternately, the first and second ends 15, 16 may be opened via a removable closure 22 (i.e., adhesive tab), end cap or other suitable closure member for prohibiting access to an interior of the bifurcated body 11 and thereby preventing premature discharge of the first and second fluids 17, 18 isolated therein. Such a structural configuration provides the unexpected and unpredictable advantage of enabling a user to hold body 11 in an upright position to drink the first fluid 17 and quickly invert body 11 to drink the second fluid 18, without fear of prematurely dispensing or mixing the first and second fluids 17, 18.

Figure 2:
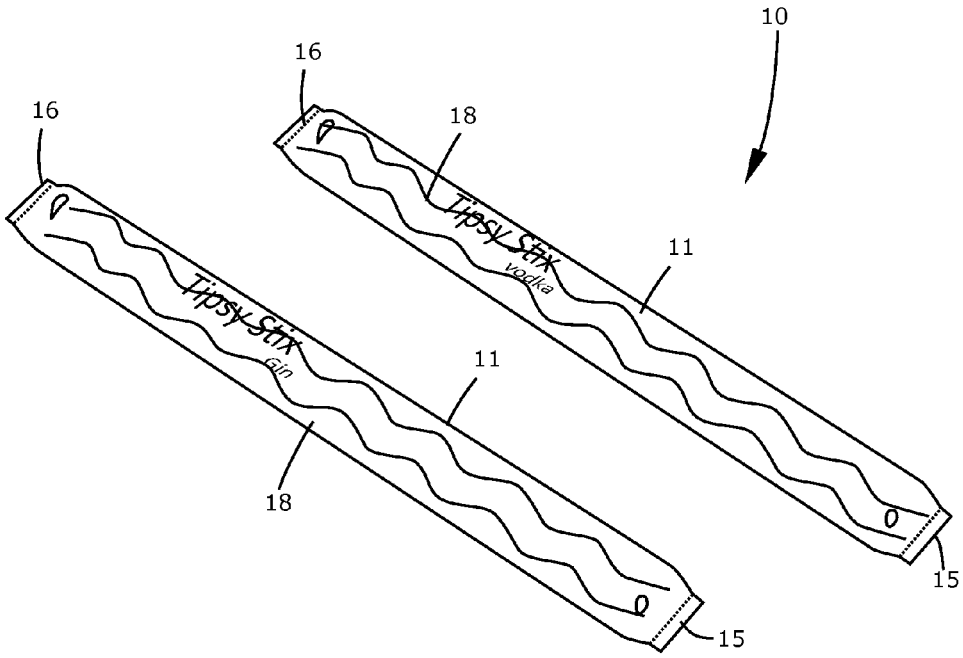
FIG. 2 is a perspective view showing a pair of fluid converged fluid dispensing bodies, in accordance with the non-limiting exemplary embodiment(s)
Figure 3:
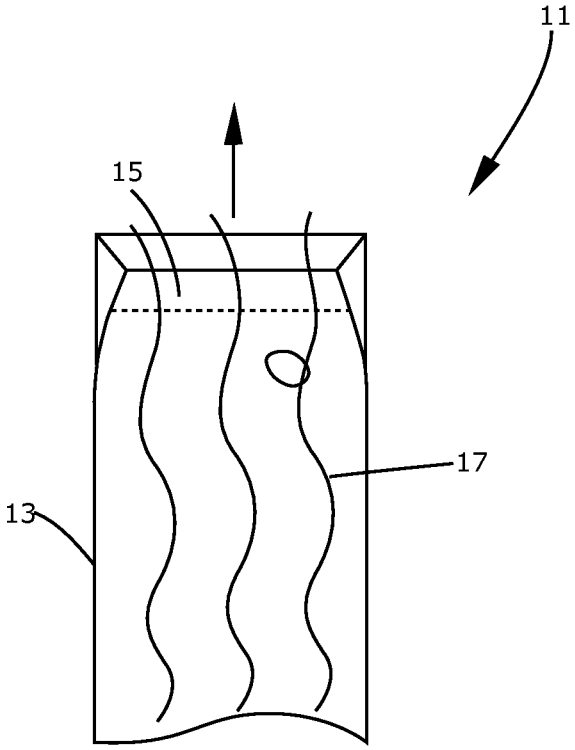
FIG. 3 is an enlarged front elevational view show an end of the body capable of being opened from a closed position.

In a non-limiting exemplary embodiment, as perhaps best shown in FIG. 2, body 11 may be unitary and not bifurcated. Such a body 11 may be formed from flexible or stiff, beverage-grade plastic, and might be configured in a straight cylindrical shape or in a cylinder in which the upper end of body 11 angles away from a centrally located longitudinal axis to form a pouring spout. One end 15 of body 11 may be permanently sealed, while the other end 16 may be fitted with a tear-open perforation; a twist-off or snap-off cap, or a similar, one-use seal.

Thus, depending upon the first and second fluid contents 17, 18, the interior of body 11 may be continuous, thus containing one liquor, liqueur, or pre-mixed shot. If body 11 is compartmentalized, the first compartment 13 may contain vodka, and the second compartment 14 may contain a chaser, perhaps soda or orange juice. In the compartmentalized embodiment, body 11 may be opened from both ends. For example, the user may first bite off the first end 15 and take the vodka shot, then turn body 11 upside down, bite off the chaser end 16 and take the chaser.

In a non-limiting exemplary embodiment, one of the first and second fluids 17, 18 remains situated within a corresponding one of the first and second compartments 13, 14, respectively, after another one of the first and second fluids 17, 18 is discharged from another corresponding one of the first and second compartments 13, 14, respectively. Such a structural configuration provides the unexpected and unpredictable advantage of permitting a user to simultaneously house first and second fluids 17, 18 in body 11 and sequentially consume first and second fluids 17, 18 from body 11.

In a non-limiting exemplary embodiment, the first and second fluids 17, 18 are prohibited from traveling beyond divider 12 and thereby respectively prohibited from entering the second and first compartments 14, 13, respectively. Such a structural configuration provides the unexpected and unpredictable advantage of ensuring each fluid 17, 18 does not prematurely mix with the other fluid 17, 18 prior to consumption.

In a non-limiting exemplary embodiment, the divider 12 spans across an entire internal cross-section of the body 11 such that the first fluid 17 is prohibited from contacting the second fluid 18. Such a structural configuration provides the unexpected and unpredictable advantage of ensuring fluids 17, 18 are not contaminated prior to consumption.

Figure 4:
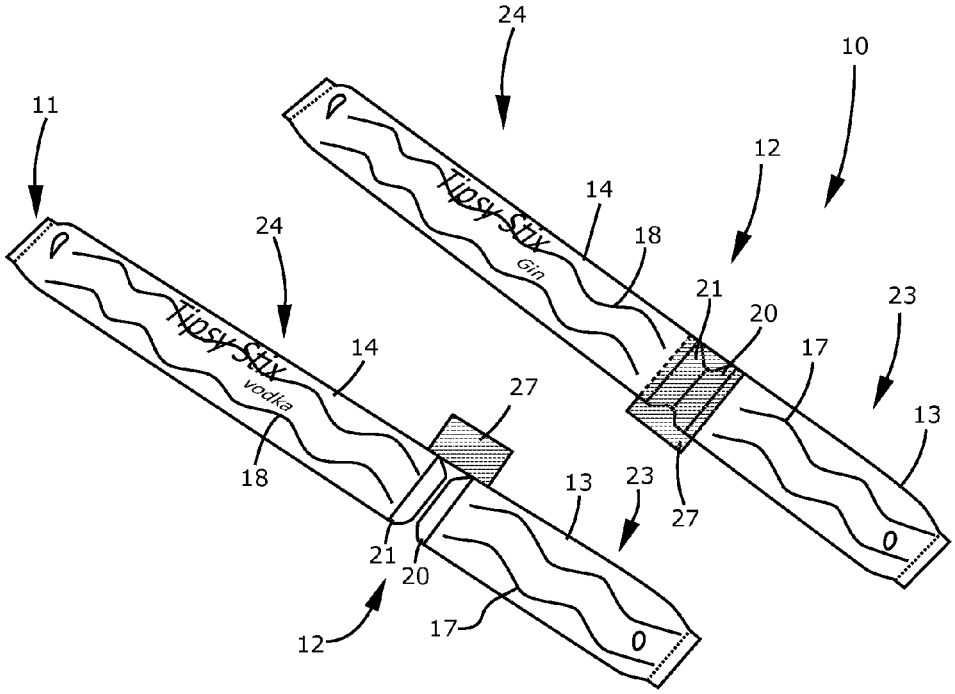
FIG. 4 is a perspective view showing the divider including first and second plates removably abutted against each other and held in place via a tear-away seal wrapped thereabout, in accordance with the non-limiting exemplary embodiment(s)
Figure 5:
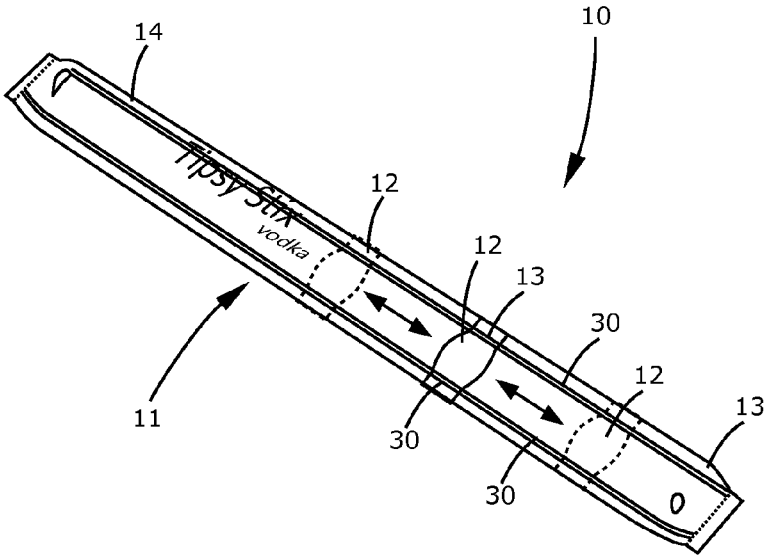
FIG. 5 is a perspective view showing the divider formed with tabs slidably reciprocated within the body such that the first and second compartments are selectively adjusted in longitudinal length, in accordance with the non-limiting exemplary embodiment(s)

In a non-limiting exemplary embodiment, as perhaps best shown in FIG. 4, the divider 12 includes first and second plates 20, 21 abutted against each other and facing the first and second compartments 13, 14, respectively. Such a structural configuration provides the unexpected and unpredictable advantage of permitting separation of body 11 at abutting ends of the first and second plates 20, 21 so that both compartments can be simultaneously held in an upright position.

In a non-limiting exemplary embodiment, the first compartment 13 begins from the first plate 20 and terminates at the first end 15 of the body 11. Such a structural configuration provides the unexpected and unpredictable advantage of preventing the first fluid 17 from passing beyond the divider 12 and entering the second compartment 14.

In a non-limiting exemplary embodiment, the second compartment 14 begins at the second plate 21 and terminates at the second end 16 of the body 11. Such a structural configuration provides the unexpected and unpredictable advantage of preventing the second fluid 18 from passing beyond the divider 12 and entering the first compartment 13.

In a non-limiting exemplary embodiment, a tear-away seal 27 is wrapped about the divider 12 and thereby holds the first and second plates 20, 21 at an abutted relationship. In this manner, the first plate 20 is detached from the second plate 21 when the tear-away seal 27 is unwrapped from the divider 12 such that the first and second compartments 13, 14 become separated and spaced apart. Such a structural configuration provides the unexpected and unpredictable advantage of permitting separation of body 11 at abutting ends of the first and second plates 20, 21, by simply unwrapping the tear-way seal 27, so that both compartments can be simultaneously held in an upright position.

In a non-limiting exemplary embodiment, body 11 may be provided with grooves 30 formed along an interior wall thereof. Divider 12 may include tabs (tongues) 31 slidably interfitted within the grooves such that divider 12 is slidably reciprocated within body 11. Such selective displacement of divider 12 enables a user to adjust a longitudinal length of first and second compartments 15, 16 as needed. Such a structural configuration provides the unexpected and unpredictable advantage of adjusting a quantity of first and second fluids 17, 18, as desired.

In a non-limiting exemplary embodiment, the present disclosure further includes a method of utilizing a bifurcated alcoholic beverage dispenser 10 for isolating a plurality of fluids 17, 18 (e.g., alcohol, juices, milk, etc.) in separate compartments before consumption. Such a method preferably includes the chronological steps of: providing a bifurcated body 11 having first and second ends 15, 16 situated at open positions, respectively; providing and disposing a divider 12 within the body 11; providing and locating first and second compartments 13, 14 at proximal and distal portions 23, 24 of the body 11 such that the first and second compartments 13, 14 are isolated by the divider 12.

The method further includes the chronological steps of: providing and housing a first fluid 17 within the first compartment 13; independently closing the first end 15 of the bifurcated body 11; providing and housing a second fluid 18 within the second compartment 14; independently closing the second end 16 of the bifurcated body 11; and independently dispensing the first and second fluids 17, 18 from the first and second compartments 13, 14 by independently opening the first and second ends 15, 16 of the bifurcated body 11, respectively.

In a non-limiting exemplary embodiment, body 11 may contain a pre-mixed (or straight) half-shot; 2) a pre-mixed (or straight) full shot; or 3) a shot, with "x" % of the alcoholic volume, and "y" % of the segregated chaser volume. The body 11 may be accessed from either end 15, 16, so each person can take the shot and immediately follow it with the chaser to have the full shot experience. No need to fuss with how many cups or shot glasses. No need to think of who may pour the shots. No need to stress over broken glass. The present disclosure provides small, compact shots for the on-the-go users.

In an alternative embodiment, the body 11 may be formed from deformably resilient material and thereby serve as a flexible wristband wrapped-around a user's wrist that may be perfect for concert-goers. Thus, the body 11 may be formed from flexible material that retains its curvilinear shape when worn around a user's wrist and thereby effectively compartmentalizes first and second fluids 17, 18 therein.

While non-limiting exemplary embodiment(s) has/have been described with respect to certain specific embodiment (s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment (s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A bifurcated alcoholic beverage dispenser for isolating a plurality of alcoholic mixtures in separate compartments before consumption, said bifurcated alcoholic beverage dispenser comprising:

a body having first and second ends each being independently opened from a closed position;

a divider disposed within said body;

first and second compartments located at proximal and distal portions of said body and isolated by said divider;

a first fluid housed within said first compartment; and a second fluid housed within said second compartment;

wherein said first and second fluids are independently dispensed from said first and second compartments when said first and second ends are independently opened, respectively;

wherein said divider comprises first and second plates abutted against each other and facing said first and second compartments, respectively;

wherein said first compartment begins from said first plate and terminates at said first end of said body;

wherein said second compartment begins at said second plate and terminates at said second end of said body;

wherein said second compartment begins at said second plate and terminates at said second end of said body;

a tear-away seal wrapped about said divider and thereby holding said first and second plates at an abutted relationship, wherein said first plate is detached from said second plate when said tear-away seal is unwrapped from said divider such that said first and second compartments become separated and spaced apart.

2. The bifurcated alcoholic beverage dispenser of claim 1, wherein said body is formed from a flexible plastic sheath such that said first and second ends are torn open from the closed position.

3. The bifurcated alcoholic beverage dispenser of claim 1, wherein one of said first and second fluids remains situated within a corresponding one of said first and second compartments, respectively, after another one of said first and second fluids is discharged from another corresponding one of said first and second compartments, respectively.

4. The bifurcated alcoholic beverage dispenser of claim 1, wherein said first and second fluids are prohibited from traveling beyond said divider and thereby respectively prohibited from entering said second and first compartments.

5. The bifurcated alcoholic beverage dispenser of claim 1, wherein said divider spans across an entire internal cross-section of said body such that said first fluid is prohibited from contacting said second fluid.

6. A bifurcated alcoholic beverage dispenser for isolating a plurality of alcoholic mixtures in separate compartments before consumption, said bifurcated alcoholic beverage dispenser comprising:

a bifurcated body having first and second ends each being independently opened from a closed position;

a divider disposed within said body;

first and second compartments located at proximal and distal portions of said body and isolated by said divider;

a first fluid housed within said first compartment; and a second fluid housed within said second compartment;

wherein said first and second fluids are independently dispensed from said first and second compartments when said first and second ends are independently opened, respectively;

wherein said divider comprises first and second plates abutted against each other and facing said first and second compartments, respectively;

wherein said first compartment begins from said first plate and terminates at said first end of said body;

wherein said second compartment begins at said second plate and terminates at said second end of said body;

a tear-away seal wrapped about said divider and thereby holding said first and second plates at an abutted relationship, wherein said first plate is detached from said second plate when said tear-away seal is unwrapped from said divider such that said first and second compartments become separated and spaced apart.

7. The bifurcated alcoholic beverage dispenser of claim 6, wherein said body is formed from a flexible plastic sheath such that said first and second ends are torn open from the closed position.

8. The bifurcated alcoholic beverage dispenser of claim 6, wherein one of said first and second fluids remains situated within a corresponding one of said first and second compartments, respectively, after another one of said first and second fluids is discharged from another corresponding one of said first and second compartments, respectively.

9. The bifurcated alcoholic beverage dispenser of claim 6, wherein said first and second fluids are prohibited from traveling beyond said divider and thereby respectively prohibited from entering said second and first compartments.

10. The bifurcated alcoholic beverage dispenser of claim 6, wherein said divider spans across an entire internal cross-section of said body such that said first fluid is prohibited from contacting said second fluid.

* * * * *